US008216438B2

(12) United States Patent
Aiba et al.

(10) Patent No.: US 8,216,438 B2
(45) **Date of Patent: *Jul. 10, 2012**

(54) COPPER ANODE OR PHOSPHOROUS-CONTAINING COPPER ANODE, METHOD OF ELECTROPLATING COPPER ON SEMICONDUCTOR WAFER, AND SEMICONDUCTOR WAFER WITH LOW PARTICLE ADHESION

(75) Inventors: Akihiro Aiba, Ibaraki (JP); Hirofumi Takahashi, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 187 days.

This patent is subject to a terminal disclaimer.

(21) Appl. No.: 12/524,623

(22) PCT Filed: Oct. 6, 2008

(86) PCT No.: PCT/JP2008/068167

§ 371 (c)(1),
(2), (4) Date: Jul. 27, 2009

(87) PCT Pub. No.: WO2009/057422

PCT Pub. Date: May 7, 2009

(65) Prior Publication Data

US 2010/0096271 A1 Apr. 22, 2010

(30) Foreign Application Priority Data

Nov. 1, 2007 (JP) ..... 2007-285148

(51) Int. Cl.
*C25B 11/04* (2006.01)

(52) U.S. Cl. ..... 204/292; 148/432; 205/50; 205/157; 205/292; 205/291

(58) Field of Classification Search ..... 204/292; 148/432; 205/50, 157, 292, 291
See application file for complete search history.

(56) References Cited

U.S. PATENT DOCUMENTS

| | | | | |
|---|---|---|---|---|
| 6,783,611 | B2 | 8/2004 | Yajima et al. | |
| 7,138,040 | B2 * | 11/2006 | Okabe et al. | 204/292 |
| 7,374,651 | B2 * | 5/2008 | Aiba et al. | 205/80 |
| 7,799,188 | B2 * | 9/2010 | Aiba et al. | 204/292 |
| 7,943,033 | B2 | 5/2011 | Aiba et al. | |
| 2003/0029527 | A1 * | 2/2003 | Yajima et al. | 148/432 |
| 2003/0188975 | A1 * | 10/2003 | Nielsen | 205/292 |
| 2004/0007474 | A1 | 1/2004 | Okabe et al. | |
| 2004/0149588 | A1 | 8/2004 | Aiba et al. | |
| 2004/0200727 | A1 * | 10/2004 | Aiba et al. | 205/157 |
| 2008/0210568 | A1 * | 9/2008 | Aiba et al. | 205/292 |
| 2010/0307923 | A1 * | 12/2010 | Aiba et al. | 205/50 |

FOREIGN PATENT DOCUMENTS

| | | | |
|---|---|---|---|
| JP | 2001-240949 | A | 9/2001 |
| JP | 2003-231995 | A | 8/2003 |

OTHER PUBLICATIONS

T. Yamane et al., "Determination of Trace Elements in the Ash of Wood and Bamboo Charcoal by PIXE Analysis", Japan Radioisotope Association, pp. 132-135, 2001 (month unknown).

* cited by examiner

*Primary Examiner* — Bruce Bell
(74) *Attorney, Agent, or Firm* — Howson & Howson LLP

(57) ABSTRACT

Provided is a copper anode or a phosphorous-containing copper anode for use in performing electroplating copper on a semiconductor wafer, wherein purity of the copper anode or the phosphorous-containing copper anode excluding phosphorous is 99.99 wt % or higher, and silicon as an impurity is 10 wtppm or less. Additionally provided is an electroplating copper method capable of effectively preventing the adhesion of particles on a plating object, particularly onto a semiconductor wafer during electroplating copper, a phosphorous-containing copper anode for use in such electroplating copper, and a semiconductor wafer comprising a copper layer with low particle adhesion formed by the foregoing copper electroplating.

9 Claims, No Drawings

COPPER ANODE OR PHOSPHOROUS-CONTAINING COPPER ANODE, METHOD OF ELECTROPLATING COPPER ON SEMICONDUCTOR WAFER, AND SEMICONDUCTOR WAFER WITH LOW PARTICLE ADHESION

BACKGROUND OF THE INVENTION

The present invention relates to a method of electroplating copper capable of effectively preventing the adhesion of particles onto a plating object, particularly onto a semiconductor wafer during copper electroplating, a phosphorous-containing copper anode for use in such copper electroplating, and a semiconductor wafer comprising a copper layer with low particle adhesion formed by the foregoing copper electroplating.

Copper electroplating is generally used for copper wiring fabrication in a PWB (print wiring board) or the like, but recently, it comes to be used for copper wiring fabrication of a semiconductor. Copper electroplating has a long history, and has reached its current state after numerous technical backlogs. However, with the use of copper electroplating for copper wiring fabrication of a semiconductor, new drawbacks which were not found with PWBs have arisen.

When performing copper electroplating, phosphorous-containing copper is generally used as the anode. This is because if an insoluble anode prepared from platinum, titanium, iridium oxide or the like is used, the additive agent in the plating solution is affected by anode oxidation and decomposes, whereby defective plating occurs. Meanwhile, when electrolytic copper or oxygen-free copper as a soluble anode is used during the dissolution, particles such as sludge containing metallic copper and copper oxide arose from the dismutation reaction of monovalent copper are generated, and the plating object may become contaminated.

Meanwhile, if a phosphorous-containing copper anode is used, a black film formed from copper phosphide, copper chloride or the like is formed on the anode surface by way of electrolysis, and this is used to prevent the generation of metallic copper or copper oxide arose from the dismutation reaction of monovalent copper, and enables the formation of a copper layer with low adhesion of particles.

Nevertheless, even if a phosphorous-containing copper is used as the anode as described above, because of the fall off of the black film or the generation of metallic copper or copper oxide at the thin portion of the black film, the generation of particles is not completely prevented.

In light of the above, the anode is usually wrapped with a filter fabric known as an anode bag in order to prevent particles from reaching the plating solution. However, when this kind of method is applied to plating, particularly to plating on a semiconductor wafer, fine particles that were not found in the wiring fabrication on the PWB and the like will reach the semiconductor wafer, and there is a problem in that such fine particles adhere to the semiconductor and cause defective plating.

The present inventors have proposed several methods of solution to solve the foregoing problems (refer to Patent Documents 1 to 4). These methods yield the effect of dramatically reducing the generation of particles compared to the conventional plating on a semiconductor wafer using a phosphorous-containing copper anode. However, a problem of the generation of fine particles to some degree has still remained even by the forgoing solution.

[Patent Document 1] Japanese Patent Laid-Open Publication No. 2000-265262

[Patent Document 2] Japanese Patent Laid-Open Publication No. 2001-98366

[Patent Document 3] Japanese Patent Laid-Open Publication No. 2001-123266

[Patent Document 4] Japanese Patent Laid-Open Publication No. 1991-180468

SUMMARY OF THE INVENTION

In light of the above, an object of the present invention is to provide a method of electroplating copper capable of effectively preventing the adhesion of particles onto a plating object, particularly onto a semiconductor wafer during copper electroplating, a phosphorous-containing copper anode for use in such copper electroplating, and a semiconductor wafer comprising a copper layer with low particle adhesion formed by the foregoing copper electroplating.

Specifically, the present invention provides:

1) A copper anode or a phosphorous-containing copper anode for use in electroplating copper on a semiconductor wafer, wherein purity of the copper anode or the phosphorous-containing copper anode excluding phosphorous is 99.99 wt % or higher, and silicon as an impurity is 10 wtppm or less;

2) The copper anode or the phosphorous-containing copper anode for use in electroplating copper on a semiconductor wafer according to paragraph 1) above, wherein silicon as an impurity is 1 wtppm or less;

3) The copper anode or the phosphorous-containing copper anode for use in electroplating copper on a semiconductor wafer according to paragraph 1) or paragraph 2) above, wherein as an impurity, sulfur is 10 wtppm or less, iron is 10 wtppm or less, manganese is 1 wtppm or less, zinc is 1 wtppm or less, and lead is 1 wtppm or less; and 4) The copper anode or the phosphorous-containing copper anode for use in electroplating copper on a semiconductor wafer according to any one of paragraphs 1) to 3) above, wherein phosphorous content rate of the phosphorous-containing copper anode is 100 to 1000 wtppm.

The present invention additionally provides:

5) A method of electroplating copper on a semiconductor wafer including the steps of using a copper anode or a phosphorous-containing copper anode in that purity of the copper anode or the phosphorous-containing copper anode excluding phosphorous is 99.99 wt % or higher and silicon as an impurity is 10 wtppm or less to electroplate copper on a semiconductor wafer, and forming a copper plated layer with low particle adhesion on the semiconductor wafer;

6) The method of electroplating copper on a semiconductor wafer according to paragraph 5) above, wherein a copper anode or a phosphorous-containing copper anode in that silicon as an impurity is 1 wtppm or less is used; and 7) The method of electroplating copper on a semiconductor wafer according to paragraph 5) or paragraph 6) above, wherein a copper anode or a phosphorous-containing copper anode in that as an impurity, sulfur is 10 wtppm or less, iron is 10 wtppm or less, manganese is 1 wtppm or less, zinc is 1 wtppm or less, and lead is 1 wtppm or less is used.

The present invention further provides:

8) A semiconductor wafer comprising a copper layer with low generation of particles formed by electroplating copper on a semiconductor wafer using the copper anode or the phosphorous-containing copper anode according to any one of paragraphs 1) to 4) above.

The present invention yields superior characteristics of enabling to stably electroplate copper on a semiconductor wafer with low particle adhesion upon copper electroplating. The copper electroplating using an anode of the present invention is effective as a method for reducing the defective plating rate resulted from particles in the copper plating of other fields in that thinning is progressing. Moreover, the copper anode or the phosphorous-containing copper anode of the present invention yields an effect of significantly reducing the adhesion of particles and contamination onto the plating object, but it additionally yields an effect of preventing the decomposition of the additive agent in the plating solution and the consequential defective plating that arises during the use of an insoluble anode of conventional methods.

DETAILED DESCRIPTION OF THE INVENTION

Generally, upon electroplating copper on a semiconductor wafer, a plating bath containing a copper sulfate plating solution is used, a copper anode or a phosphorous-containing copper anode is used as the anode, and a semiconductor wafer for the like is used as the cathode for plating.

As described above, when using a phosphorous-containing copper as the anode in electroplating, a black film having copper phosphide and copper chloride as its primary component is formed on the surface, and has the function of preventing the generation of particles such as sludge containing metallic copper and copper oxide arose from the dismutation reaction of monovalent copper during the dissolution of the anode. Although the present invention is also effective in cases of standard copper plating using a copper anode, a case of using a phosphorous-containing copper as the anode, which is particularly effective, is explained below.

The generation speed of the black film is strongly affected by the current density of the anode, the crystal grain size, the phosphorous content rate and the like. The tendency is that the generation speed of black films becomes faster and consequently the black film becomes thicker, under such conditions as higher the current density, smaller the crystal grain size and higher the phosphorous content rate.

Contrarily, the generation speed of black films becomes slower and consequently the black film becomes thinner, under such conditions as lower the current density, larger the crystal grain size and lower the phosphorous content rate.

As described above, the black film has the function of preventing the generation of particles containing metallic copper, copper oxide and the like, but when the black film is too thick, a serious problem arises that the black film will peel and fall off and such black film itself will cause the generation of particles.

Contrarily, when the black film is too thin, there is a problem in that the effect of preventing the generation of metallic copper, copper oxide and the like will decrease. Accordingly, in order to prevent the generation of particles from the anode, it was recognized that it is necessary to optimize the current density, the crystal grain size, and the phosphorous content rate to form a stable black film of an appropriate thickness, and to thereby realize a surface condition (crystal grain size) of the anode in that such black film will not fall off.

Nevertheless, by observing particle adhesion to a plating object such as a semiconductor wafer, it has been discovered that anode alone was not sufficient, since the particle adhesion did not necessarily decrease.

As a result of studying this phenomenon, it has been discovered that the purity of the copper anode or the phosphorous-containing copper anode is much related, and the purity of the copper anode or the phosphorous-containing copper anode needs to be 99.99 wtppm or higher, and preferably 99.995 wtppm or higher. However, this alone was not sufficient either, and the further observation of the particle adhesion status has lead to discover that what causes to increase particles is the silicon (Si) contained in the copper anode or the phosphorous-containing copper anode.

In light of the above, it has been confirmed that, with a copper anode or a phosphorous-containing copper anode for use in electroplating copper on a semiconductor wafer, it is extremely effective if the purity of the copper anode or the phosphorous-containing copper anode excluding phosphorous is 99.99 wt % or higher, and silicon as an impurity is 10 wtppm or less. Inventors of the present invention have ascertained that, even if trace amounts of silicon are contained as an impurity, such silicon is easily segregated in the copper anode or the phosphorous-containing copper anode, and the segregated silicon falls off and the place where the silicon has been becomes a cavity, which is the primary cause of the generation of particles in the plating solution.

With regard to a copper anode or a phosphorous-containing copper anode for use in electroplating copper on a semiconductor wafer, the conventional technology has been totally unaware that the purity of the anode is a major factor, and there is no copper anode or phosphorous-containing copper anode that has realized high purity like this. Particularly on the phosphorous-containing copper anode, because a black film layer appears on the surface, the conventional technology has been unaware of the problem inside the anode, that is, the purity of the anode.

As evident from the above, since the purity of the copper anode and the reduction of silicon is the factor to effectively reduce the generation of particles, it is not necessary to differentiate the copper anode from the phosphorous-containing copper anode. Thus it is easily understood that the present invention is effective for both the copper anode and the phosphorous-containing copper anode.

More preferably, the purity of the copper anode or the phosphorous-containing copper anode is 99.995 wt % or higher, and silicon as an impurity is 1 wtppm or less.

Generally, silicon gives a great influence on impurities contained in the copper anode or the phosphorous-containing copper anode, however, other impurities besides silicon affect the generation of particles to some extent. Thus firstly, silicon needs to be reduced effectively, then reducing other impurities of the following at indicated values is effective: sulfur is 10 wtppm or less, iron is 10 wtppm or less, manganese is 1 wtppm or less, zinc is 1 wtppm or less, and lead is 1 wtppm or less.

The present invention proposes the reduction of the various impurities as a more preferable condition as described above. However, even if the impurities exceed the foregoing range, there will not be a significant influence so as long as the comprehensive purity of the copper anode or the phosphorous-containing copper anode is maintained and the foregoing upper limit of the silicon is also maintained, and it should be understood that the foregoing reduction of the various impurities is a more preferable condition.

The reduction of impurities of the copper anode or the phosphorous-containing copper anode as described above is a major constituent feature of the present invention, but it should be understood that the method of electroplating copper on a semiconductor wafer and a semiconductor wafer with low particle adhesion are also important aspects of the present invention.

As described above, electroplating copper with the anode of the present invention enables to prevent the particles from reaching the semiconductor wafer, from adhering to the semiconductor wafer and from causing defective plating.

The copper electroplating using this kind of copper anode or phosphorous-containing copper anode is effective as a method for reducing the defective plating rate resulting from particles in the copper plating of other fields in that thinning is progressing.

As described above, the copper anode or the phosphorous-containing copper anode of the present invention yields an effect of not only significantly reducing the contamination of the plating object caused by the generation of large quantities of particles, but also preventing the decomposition of the additive agent in the plating solution and the consequential defective plating that arises during the use of an insoluble anode of conventional methods.

As the plating solution, 10 to 70 g/L (Cu) of copper sulfate, 10 to 300 g/L of sulfuric acid, 20 to 100 mg/L of chlorine ion, and a proper quantity of an additive agent (1 mL/L of such as CC-1220 by Nikko Metal Plating) may be used.

In addition, the plating bath temperature is set at 15 to 35° C., the cathode current density is set to 0.5 to 10 A/dm$^2$, and the anode current density is set to 0.5 to 10 A/dm$^2$. The preferable plating conditions are illustrated above, but the present invention is not necessarily limited to the foregoing conditions.

EXAMPLES

Examples of the present invention are now explained. These Examples merely illustrate a preferred example, and the present invention shall in no way be limited thereby. In other words, all modifications, other embodiments and modes covered by the technical spirit of the present invention shall be included in this invention.

Example 1

A phosphorous-containing copper anode having a purity of 99.995 wt % and silicon of 5 wtppm were used. The phosphorous content rate of the phosphorous-containing copper anode was set to 460 wtppm. A semiconductor wafer was used as the cathode. The impurity was 0.005 wt % (50 wtppm).

As the plating solution, 20 g/L (Cu) of copper sulfate, 200 g/L of sulfuric acid, 60 mg/L of chlorine ion, and 1 mL/L of an additive agent [brightening agent, surface active agent] (product name CC-1220, by Nikko Metal Plating) were used. The purity of copper sulfate in the plating solution was 99.99%.

The plating conditions were bath temperature at 30° C., cathode current density of 3.0 A/dm$^2$, anode current density of 3.0 A/dm$^2$, and 1 minute of time.

After the plating, the generation of particles and the plating appearance were observed. Incidentally, the number of particles was measured using a particle counter for particles of 0.2 μm or larger which adhered to a 12-inch ϕ semiconductor wafer upon performing electrolysis under the foregoing electrolysis conditions thereafter replacing the semiconductor wafer, and then performing plating for 1 minute.

The plating appearance was observed visually on the status of yellowing, tarnish, swelling, anomalous deposition, adhesion of foreign substance and the like upon performing electrolysis under the foregoing electrolysis conditions, thereafter replacing the semiconductor wafer, and then plating for 1 minute. With respect to the embeddability, the via embeddability of the semiconductor wafer having an aspect ratio of 5 (via diameter of 0.2 μm) was subject to cross-section observation using an electron microscope.

Consequently, in Example 1, the result of 7 particles per wafer was extremely low and the plating appearance and embeddability were also favorable.

Example 2

Subsequently, a phosphorous-containing copper anode having a purity of 99.997 wt % and silicon of 0.03 wtppm was used, and sulfur was set to 3.4 wtppm, iron was set to 4.4 wtppm, manganese was set to 0.1 wtppm, zinc was set to 0.05 wtppm, and lead was set to 0.17 wtppm; whereby the total impurity was set to 8.15 wtppm. The total amount of impurities including other kinds of impurity was set to approximately 0.003 wt % (30 wtppm).

Moreover, the phosphorous content rate of the phosphorous-containing copper anode was set to 460 wtppm. A semiconductor wafer was used as the cathode. The solution and conditions for plating were the same as Example 1.

After the plating, the generation of particles and the plating appearance were observed. Incidentally, the number of particles was measured using a particle counter for particles of 0.2 μm or larger which adhered to a 12-inch ϕ semiconductor wafer upon performing electrolysis under the foregoing electrolysis conditions, thereafter replacing the semiconductor wafer, and then performing plating for 1 minute.

Moreover, the plating appearance was observed visually on the status of yellowing, tarnish, swelling, anomalous deposition, adhesion of foreign substance and the like upon performing electrolysis under the foregoing electrolysis conditions, thereafter replacing the semiconductor wafer, and then plating for 1 minute. With respect to the embeddability, the via embeddability of the semiconductor wafer having an aspect ratio of 5 (via diameter of 0.2 μm) was subject to cross-section observation using an electron microscope.

Consequently, in Example 2, the result of 3 particles per wafer was extremely low, the plating appearance and embeddability were also favorable, and improved in comparison to Example 1.

Comparative Example 1

Subsequently, a phosphorous-containing copper anode having a purity of 99.99 wt % and 10.9 wtppm of silicon was used, and as an impurity, sulfur was set to 14.7 wtppm, iron was set to 11 wtppm, manganese was set to 16 wtppm, zinc was set to 3.3 wtppm, and lead was set to 1.8 wtppm, whereby the total impurities was set to 57.7 wtppm. The total impurity amount including other kinds of impurity was set to approximately 0.01 wt % (100 wtppm). Moreover, the phosphorous content rate of the phosphorous-containing copper anode was set to 460 wtppm. A semiconductor wafer was used as the cathode.

As the plating solution, similar to the foregoing Examples, 20 g/L (Cu) of copper sulfate, 200 g/L of sulfuric acid, 60 mg/L of chlorine ion, and 1 mL/L of an additive agent [brightening agent, surface active agent](product name CC-1220, by Nikko Metal Plating) were used. The purity of copper sulfate in the plating solution was 99.99%.

The plating conditions were the same as the foregoing Examples; namely, bath temperature at 30° C., cathode current density of 3.0 A/dm$^2$, anode current density of 3.0 A/dm$^2$, and 1 minute of time.

After the plating, the generation of particles and the plating appearance were observed. The number of particles, plating appearance, and embeddability were similarly evaluated as with the Examples.

Consequently, in Comparative Example 1, the plating appearance and embeddability were favorable; however, the result of 27 particles per wafer was significantly high adhesion to the semiconductor wafer, that is, inferior results.

Example 3

A pure copper anode having a purity of 99.995 wt % and silicon of 0.02 wtppm, sulfur of 2.0 wtppm, iron of 2.5 wtppm, and each of manganese, zinc, and lead being 0.1 wtppm (the total of the impurities of 4.82 wtppm, and other impurities of 30 wtppm) was used. A semiconductor wafer was used as the cathode. Based on the above, the total impurity content was 34.82 wtppm.

As the plating solution, 20 g/L (Cu) of copper sulfate, 200 g/L of sulfuric acid, 60 mg/L of chlorine ion, and 1 mL/L of an additive agent [brightening agent, surface active agent] (product name CC-1220, by Nikko Metal Plating) were used. The purity of copper sulfate in the plating solution was 99.99%.

The plating conditions were bath temperature at 30° C., cathode current density of 3.0 A/dm$^2$, anode current density of 3.0 A/dm$^2$, and 1 minute of time.

After the plating, the generation of particles and the plating appearance were observed. Incidentally, the number of particles was measured using a particle counter for particles of 0.2 μm or larger which adhered to a 12-inch ϕ semiconductor wafer upon performing electrolysis under the foregoing electrolysis conditions, thereafter replacing the semiconductor wafer, and then performing plating for 1 minute.

Moreover, the plating appearance was observed visually on the status of yellowing, tarnish, swelling, anomalous deposition, adhesion of foreign substance and the like upon performing electrolysis under the foregoing electrolysis conditions, thereafter replacing the semiconductor wafer, and then plating for 1 minute. With respect to the embeddability, the via embeddability of the semiconductor wafer having an aspect ratio of 5 (via diameter of 0.2 μm) was subject to cross-section observation using an electron microscope.

Consequently, in Example 3, the result of 7 particles per wafer was extremely low adhesion, and the plating appearance and embeddability were also favorable.

Specific numerical values are not indicated regarding cases other than the foregoing Examples, however, the case of a copper anode or a phosphorous-containing copper anode in that the purity of the copper anode or the phosphorous-containing copper anode excluding phosphorous is 99.99 wt % or higher and silicon as an impurity is 10 wtppm or less showed favorable result in that the number of particles was 10 wtppm or less per wafer, which was extremely low, and the plating appearance and embeddability were also favorable.

The present invention yields superior characteristics of enabling to stably electroplate copper on a semiconductor wafer with low particle adhesion upon electroplating copper. The copper electroplating using an anode of the present invention is effective as a method for reducing the defective plating rate resulting from particles in the copper plating of other fields in that thinning is progressing. Moreover, the copper anode or the phosphorous-containing copper anode of the present invention yields an effect of significantly reducing the adhesion of particles and contamination onto the plating object, but it additionally yields an effect of preventing the decomposition of the additive agent in the plating solution and the consequential defective plating that arises during the use of an insoluble anode of conventional methods. Consequently, the present invention is extremely effective for use in electroplating copper on a semiconductor wafer.

The invention claimed is:

1. A phosphorous-containing copper anode for use in electroplating copper on a semiconductor wafer, wherein purity of the phosphorous-containing copper anode excluding phosphorous is 99.99 wt % or higher and up to 99.997 wt %, and silicon as an impurity is 10 wtppm or less and sulfur as an impurity is 10 wtppm or less, and a phosphorous content of the phosphorous-containing copper-anode is 100 to 1000 wtppm.

2. The phosphorous-containing copper anode for use in electroplating copper on a semiconductor wafer according to claim 1, wherein silicon as an impurity is 1 wtppm or less.

3. The phosphorous-containing copper anode for use in electroplating copper on a semiconductor wafer according to claim 2, wherein as impurity, iron is 10 wtppm or less, manganese is 1 wtppm or less, zinc is 1 wtppm or less, and lead is 1 wtppm or less.

4. The phosphorous-containing copper anode for use in electroplating copper on a semiconductor wafer according to claim 1, wherein as an impurity, iron is 10 wtppm or less, manganese is 1 wtppm or less, zinc is 1 wtppm or less, and lead is 1 wtppm or less.

5. A method of electroplating copper on a semiconductor wafer including the steps of using a phosphorous-containing copper anode having 100 to 1000 wtppm of phosphorous content in that purity of the phosphorous-containing copper anode excluding phosphorous is 99.99 wt % or higher and up to 99.997 wt %, and silicon as an impurity is 10 wtppm or less and sulfur as an impurity is 10 wtppm or less to electroplate copper on a semiconductor wafer, and forming a copper plated layer with low particle adhesion on the semiconductor wafer.

6. The method of electroplating copper on a semiconductor wafer according to claim 5, wherein the phosphorous-containing copper anode used during said forming step has silicon as an impurity of 1 wtppm or less.

7. The method of electroplating copper on a semiconductor wafer according to claim 6, wherein the phosphorous-containing copper anode used during said forming step has as an impurity, iron of 10 wtppm or less, manganese of 1 wtppm or less, zinc of 1 wtppm or less, and lead of 1 wtppm or less.

8. The method of electroplating copper on a semiconductor wafer according to claim 5, wherein the phosphorous-containing copper anode used during said forming step has as an impurity, iron of 10 wtppm or less, manganese of 1 wtppm or less, zinc of 1 wtppm or less, and lead of 1 wtppm or less.

9. A semiconductor wafer having a copper layer with low generation of particles formed by a process comprising the step of electroplating copper on a semiconductor wafer using a phosphorous-containing copper anode having 100 to 1000 wtppm of phosphorous, a purity excluding phosphorous of 99.99 wt % or higher and up to 99.997 wt %, and silicon as an impurity of 10 wtppm or less and sulfur as an impurity is 10 wtppm or less.

* * * * *